US006213928B1

(12) United States Patent
Joshi et al.

(10) Patent No.: US 6,213,928 B1
(45) Date of Patent: Apr. 10, 2001

(54) METHOD AND APPARATUS FOR MEASURING THE THICKNESS OF SLUDGE DEPOSITED ON THE SIDEWALL OF A CENTRIFUGE

(76) Inventors: Shrinivas G. Joshi, 20340 Downing Ct., Brookfield, WI (US) 53045; Boris D. Zaitsev, 1714 W. Kilbourn Ave., Milwaukee, WI (US) 53233

( * ) Notice: Subject to any disclaimer, the term of this patent is extended or adjusted under 35 U.S.C. 154(b) by 0 days.

(21) Appl. No.: 09/376,038

(22) Filed: Aug. 17, 1999

(51) Int. Cl.[7] ..... B04B 9/06; B04B 15/00
(52) U.S. Cl. ..... 494/10; 494/37; 494/49
(58) Field of Search ..... 494/1, 10, 36, 494/37, 38, 49, 56, 85, 2, 3; 210/86, 103, 104, 746, 781, 360.1; 73/291

(56) References Cited

U.S. PATENT DOCUMENTS 2,727,630 * 12/1955 Hertrich .
3,011,641 * 12/1961 Huser .
3,019,902 * 2/1962 McPhee et al. .
3,044,625 * 7/1962 Smith et al. .
3,141,846 * 7/1964 Laven, Jr. .
3,189,268 * 6/1965 Nilsson .
3,420,374 * 1/1969 Umeda .
3,559,808 * 2/1971 O'Conor .
3,718,278 * 2/1973 Conklin .
3,986,663 * 10/1976 Jonsson et al. .
4,221,323 * 9/1980 Courtot .
4,229,298 10/1980 Bange .
4,522,620 * 6/1985 Leister ..... 494/10
4,900,453 2/1990 Sedlmayer .
5,253,529 * 10/1993 Lenormand et al. ..... 494/10
5,254,241 * 10/1993 Bange et al. ..... 210/360.1
5,736,054 * 4/1998 Feller et al. ..... 494/37
5,897,786 * 4/1999 Henkel et al. ..... 494/10
5,900,156 * 5/1999 Zeigler ..... 210/360.1
5,948,271 * 9/1999 Wardwell et al. ..... 494/37
6,063,292 * 5/2000 Leung ..... 210/781

FOREIGN PATENT DOCUMENTS

318370 * 5/1989 (EP) ..... 494/10

* cited by examiner

*Primary Examiner*—Charles E. Cooley
(74) *Attorney, Agent, or Firm*—Andrus, Sceales, Starke & Sawall, LLP

(57) ABSTRACT

A method and apparatus for measuring the thickness of sludge being deposited on the sidewall of a rotating turbine can in a centrifuge by measuring the electrical admittance (capacitance or conductance) between the sidewall of the turbine can and the base, shaft, or body of the centrifuge which is electrically isolated from the turbine can. An electrical circuit is coupled to the sidewall of the turbine can to measure a change in the thickness of the sludge being deposited on the inner surface of the sidewall by measuring a change in voltage, admittance, capacitance, or conductance between the turbine can and the base, shaft or body of the centrifuge which are all at ground potential. The apparatus of the invention includes a typical centrifuge which is modified by adding a pair of insulating rings to the structure of the centrifuge to electrically isolate the turbine can from the rest of the centrifuge structure.

16 Claims, 4 Drawing Sheets

METHOD AND APPARATUS FOR MEASURING THE THICKNESS OF SLUDGE DEPOSITED ON THE SIDEWALL OF A CENTRIFUGE

BACKGROUND OF THE INVENTION

The present invention relates to centrifuges, and more particularly, to an improved method and apparatus for measuring the thickness of sludge being deposited against the sidewall of a rotating turbine can in a centrifuge, by measuring the electrical admittance between the sidewall and the base, shaft or body of the centrifuge which are usually at ground potential.

Centrifuges are widely used in many fields of science and industry. Centrifuges use centrifugal force for various applications such as separating solids from liquids and separating heavier liquids from lighter liquids, etc. One application of a centrifuge is to separate metal and other particulate matter from lubricating oils. In this application, the centrifuge acts as a device for filtering dirty oil. Dirty oil under high pressure is inserted into the rotating turbine can of a centrifuge. The turbine can is rotating at a very high speed. Due to centrifugal force, heavier particles are repelled outwards, removed from the oil, and deposited on the sidewall of the rotating can. This results in the formation of a layer of sludge or particulate matter on the sidewall of the can which keeps increasing as the cleaning process continues. From an application point of view, it is very useful to be able to monitor the thickness of the sludge layer continuously as it is increasing during operation of the centrifuge.

The prior art discloses methods and apparatus for measuring the thickness of sludge being deposited on the sidewall of a rotating centrifugal basket or can while the centrifuge is operating. For example, U.S. Pat. No. 4,229,298 to Bange discloses a method and apparatus for determining the thickness of a charge wall being formed on the sidewall of a centrifugal basket. An electrically conductive plate is disposed in the open basket inwardly of the sidewall to provide a source of voltage for establishing an electric field between the plate and the sidewall. A capacitance sensor is used to sense a change in the capacitance resulting from the formation of a charge wall on the sidewall of the rotating basket.

The addition of the conductive plate requires a centrifuge with an open rotating basket or can. The electrode cannot be inserted into a centrifuge having a closed basket for filtering liquids under high pressure. Thus, the method and apparatus disclosed in the Bange patent is limited to centrifuges having an open rotating basket.

In the present invention, no additional conductive plate, electrode, or rod is introduced. Instead, the present invention measures the admittance (capacitance or conductance) between the turbine can sidewall and the base, shaft, or body of the centrifuge. In a typical centrifuge, the turbine can is usually electrically shorted or connected to the base, shaft and body of the centrifuge. Therefore it is not apparent that one can measure the admittance between them. This is the reason the Bange patent introduces an extra conductive electrode. The present invention modifies the centrifuge by electrically isolating the turbine can from the rest of the centrifuge structure (i.e. the combined base, shaft and body). The modification to the centrifuge is relatively simple and does not affect its operation.

Frequently, it happens that the thickness of sludge on the sidewall of the basket or can is not uniform. The method disclosed by the prior art carries out a local measurement on a small portion of the sidewall. Thus, the method measures the sludge thickness in an area opposite the fixed electrode. The method used by the present invention has an integral character and provides the average value of sludge thickness deposited on the sidewall of the centrifuge. This is parameter that is more accurate and useful than the local thickness at a certain limited region of the centrifuge.

The advantages of the present invention over the prior art are that the present invention is cheaper and simpler to implement, the invention works with minimal modifications to the centrifuge, and the prior art can only be used in centrifuges having an open rotating basket or can. The prior art method and apparatus cannot be used in cases where the rotating turbine can is closed and/or includes high pressure liquids inside it. It should also be noted that it is very difficult to place an additional fixed electrode or rod inside a rotating can. The addition of an extra conductive electrode may disturb the symmetry of the centrifuge and the thickness of the sludge near the electrode may become non-uniform. In this case, the data obtained from the device will be erroneous. In the present invention, the symmetry of the centrifuge is not disturbed.

SUMMARY OF THE INVENTION

The method of the present invention is based on measuring the electrical admittance between two suitable points in the centrifuge. One point is located on the base shaft body, while the other point is located on the turbine can. The base shaft body is usually connected to ground. The electrical connection made to the turbine can is shown in FIG. 1. Between the electrical connection and ground, the centrifuge looks essentially like a coaxial capacitor. The dielectric of the capacitor is a mixture of oil and sludge.

The centrifuge includes an outer body connected to a base. Extending upwardly from the center of the base is a center shaft or spindle which allows rotation of a rotor turbine rotatably mounted on the spindle. Connected to the rotor turbine is a baffle screen assembly with a plurality of openings extending therethrough. Also attached to rotor turbine is a rotatable turbine can having a sidewall with an inner surface and an outer surface. The centrifuge further includes an o-ring for sealing the connection between the rotor turbine, the baffle screen assembly, and the turbine can near the bottom of the rotating parts of the centrifuge. The rotatable turbine can is closed at both ends for cleaning liquids under high pressure. The rotor turbine, the baffle screen assembly, and the turbine can all rotate around the center shaft.

The centrifuge operates by accepting a pressurized liquid such as dirty lubricating oil into an input in the center of the base of the centrifuge. The liquid moves up through a channel in the center shaft, exits the channel through openings in the side of the shaft, and moves up through a space between the center shaft and the rotor turbine. The liquid passes through openings in the rotor turbine, and moves up through a space between the rotor turbine and the baffle screen assembly. The liquid then enters the turbine can of the centrifuge which is rotating at a high rate of speed to cause particulate matter to be separated from the liquid and deposited as sludge on the inner surface of the rotating turbine can sidewall. The filtered liquid passes through a plurality of openings in the baffle screen assembly, moves down through a space between the baffle screen assembly and the rotor turbine, and comes out through openings at the bottom of the rotor turbine. The filtered liquid finally flows out of the centrifuge through openings in the base of the centrifuge for collection. The thickness of sludge deposited on the inner surface of the turbine can sidewall keeps increasing during operation of the centrifuge. The present invention discloses a novel method and apparatus for measuring the average thickness of sludge being deposited on the rotating turbine can entire sidewall during operation of the centrifuge.

The method of the present invention is based on measuring the electrical admittance between two points on the centrifuge in a temperature-independent maner. In order to perform this measurement, the rotating turbine can must be electrically isolated from the rest of the centrifuge structure. The electrical isolation is achieved by adding two insulating rings to the centrifuge structure between the rotor turbine and the turbine can, and between the turbine can and structure holding the internal components of the centrifuge together.

To perform the measurement, an electric circuit is coupled to the centrifuge at a point on the sidewall of the turbine can and a point on the base, shaft or body of the centrifuge which have been electrically isolated from the turbine can. The circuit generates a signal at a given frequency which is coupled to the input on the turbine can. This signal is continuously monitored during operation of the centrifuge to determine changes in voltage, admittance, capacitance or conductance. These measured values all vary as a function of average sludge thickness, thereby making it possible to measure small changes in these values and determining an accurate value of average sludge thickness on the entire sidewall of the rotating turbine can.

Various other features, objects, and advantages of the invention will be made apparent from the following detailed description and the drawings.

BRIEF DESCRIPTION OF THE DRAWING

The drawings illustrate the best mode presently contemplated of carrying out the invention. In the drawings.

DETAILED DESCRIPTION OF THE INVENTION

Figure 1:
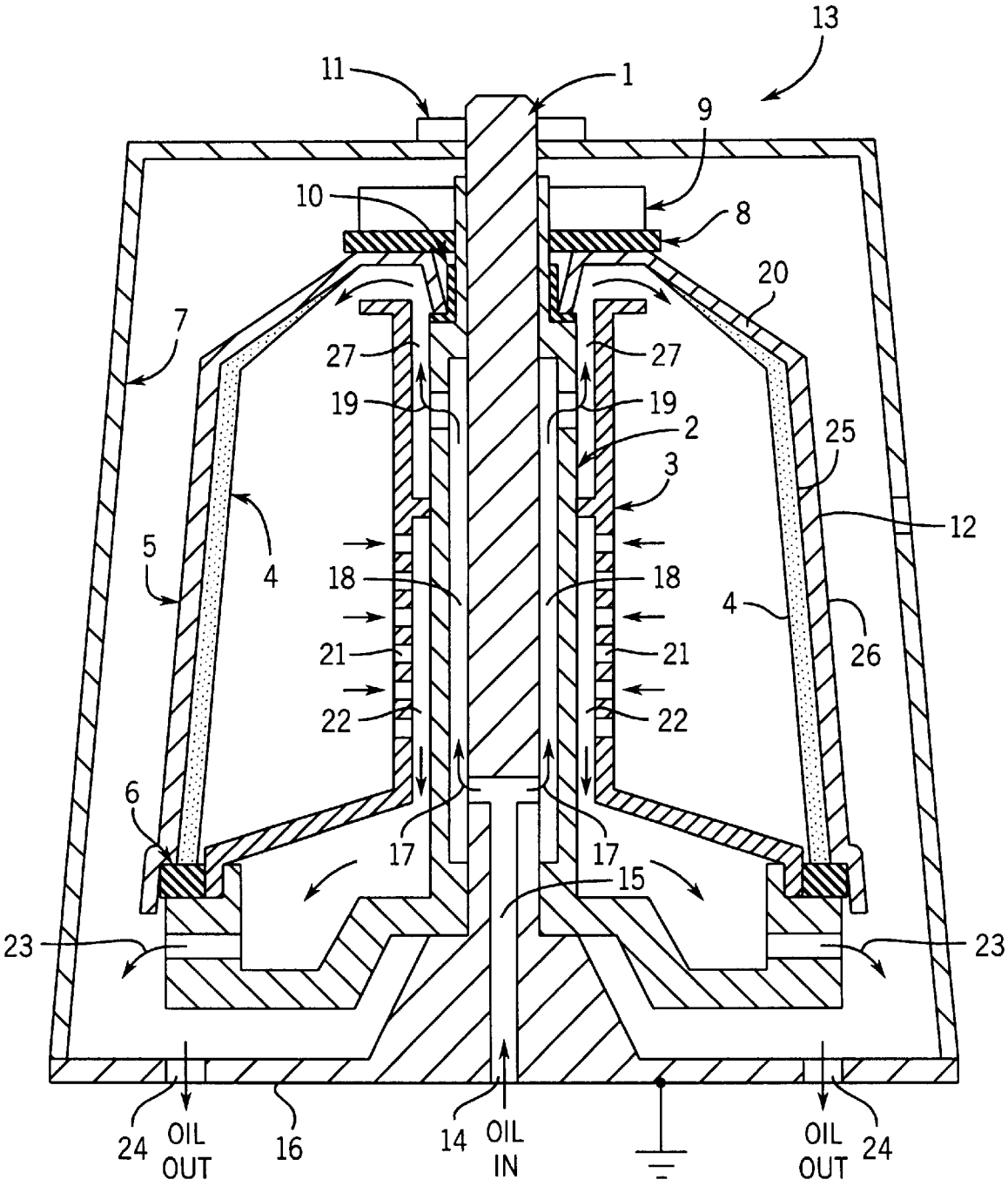
FIG. 1 is a cross sectional view of a centrifuge used in accordance with the present invention.

FIG. 1 illustrates a cross sectional view of a centrifuge 13 used to remove particulate matter from liquids, especially lubricating oils. The centrifuge 13 includes an outer body 7 connected to a base 16. Extending upwardly from the center of the base 16 is a center shaft or spindle 1 which allows rotation of a rotor turbine 2 rotatably mounted on the spindle 1. the top of spindle 1 is provided with a fixed nut 11. Connected to the rotor turbine 2 is a baffle screen assembly 3 with a plurality of openings 21 extending therethrough. Also attached to rotor turbine 2 is a rotatable turbine can 5 having a sidewall 20 with an inner surface 25 and an outer surface 26. The centrifuge 13 further includes an o-ring 6 for sealing the connection between the rotor turbine 2, the baffle screen assembly 3, and the turbine can 5 near the bottom of the rotating parts of the centrifuge 13. The rotatable turbine can 5 is closed at both ends for cleaning liquids under high pressure. The rotor turbine 2, the baffle screen assembly 3, and the turbine can 5 all rotate around the center shaft or spindle 1 during operation of the centrifuge 13. The can 5 is free of internal structure (e.g., rods) as shown in FIG. 1.

As shown in FIG. 1, a pressurized liquid such as dirty lubricating oil enters through an input 14 in the center of base 16 of the centrifuge 13, moves up through a channel 15 in the center shaft 1, exits channel 15 through openings 17 in the side of the shaft 1, and moves up through a space 18 between the center shaft 1 and the rotor turbine 2. The liquid passes through openings 19 in the rotor turbine 2, and moves up through a space 27 between the rotor turbine 2 and the baffle screen assembly 3. The liquid then enters the turbine can 5 of the centrifuge 13. Rotation of the turbine can 5 causes the particulate matter to be separated from the liquid and deposited as sludge 4 on the inner surface 25 of the can sidewall 20. The filtered liquid passes through a plurality of openings 21 in the baffle screen assembly 3, moves down through a space 22 between the baffle screen assembly 3 and the rotor turbine 2, and comes out through openings 23 at the bottom of the rotor turbine 2. The filtered liquid finally flows out of the centrifuge 13 through openings 24 in the base 16 of the centrifuge 13. The thickness of sludge 4 deposited on the entire inner surface 25 of the turbine can sidewall 20 keeps increasing during operation of the centrifuge 13. The path of a liquid flowing through the centrifuge 13 is shown by the plurality of arrows in FIG. 1.

The method of the present invention is based on measuring the electrical admittance (capacitance or conductance) between two suitable points on the centrifuge 13 in a temperature-independent manner. One point is located on the base 16, shaft 1, or body 7 of the centrifuge 13, while the other point is located on the turbine can 5. The structure of the centrifuge 13 is usually totally connected together, so that the turbine can 5 must be electrically isolated from the rest of the centrifuge structure in order to attach a circuit to the centrifuge and perform the admittance measurement of the present invention. The electrical connection of the circuit to the turbine can 5 is shown at 12 in FIG. 1. Between the sidewall 20 of the rotating can 5 and the shaft 1, the centrifuge 13 looks essentially like a coaxial capacitor, with the dielectric being the mixture of liquid and sludge.

Electrical isolation of the rotating turbine can 5 from the rest of the centrifuge structure (i.e. the combined base 16, shaft 1 and body 7) is achieved by adding two insulating rings 8 and 10 to the centrifuge 13. A first dielectric ring 10 is placed between the rotor turbine 2 and the turbine can 5 to isolate the turbine can 5 from the rotor turbine 2. A second dielectric ring 8 is placed between the turbine can 5 and a lock nut 9 located at the top of the centrifuge to isolate the turbine can 5 from the lock nut 9. Now the turbine can 5 is electrically isolated from the outer body 7, the base 16, the center shaft 1, the rotor turbine 2, and the baffle screen assembly 3 which are all at ground potential. This modification of the centrifuge 13 does not affect its operation, since the centrifuge 13 is still balanced.

Theoretical analysis shows that the admittance (capacitance or conductance) of this lossy capacitor formed of the centrifuge 13 will vary with respect to average sludge thickness deposited on the sidewall 20 of the rotating turbine can 5 during operation of the centrifuge 13. This hypothesis has been verified by carrying out measurements of capacitance and conductance for different values of sludge thickness.

Figure 2A:
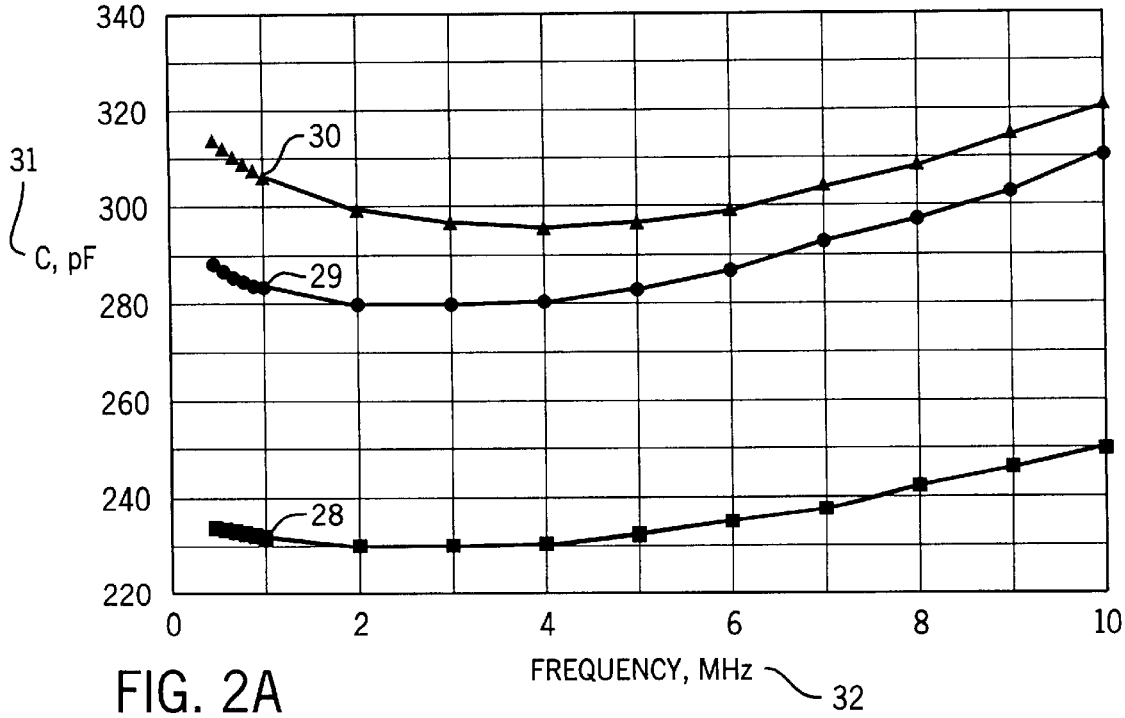
FIG. 2A is a graph which plots capacitance as a function of frequency for three different thicknesses of sludge deposited on the sidewall of the centrifuge.

FIG. 2A shows a graph of the capacitance 31 as a function of frequency 32 for three different thicknesses of sludge deposited on the sidewall of the rotating turbine can 5. The first set of points 28 indicates no sludge present on the sidewall 20 of the turbine can 5. The second set of points 29 indicates a sludge thickness of approximately 0.3 inches. The third set of points 30 indicates a sludge thickness of approximately 0.4 inches. As can be seen from FIG. 2A, at a given frequency, the capacitance of the turbine can 5 in the centrifuge 13 varies as a function of sludge thickness.

Figure 2B:
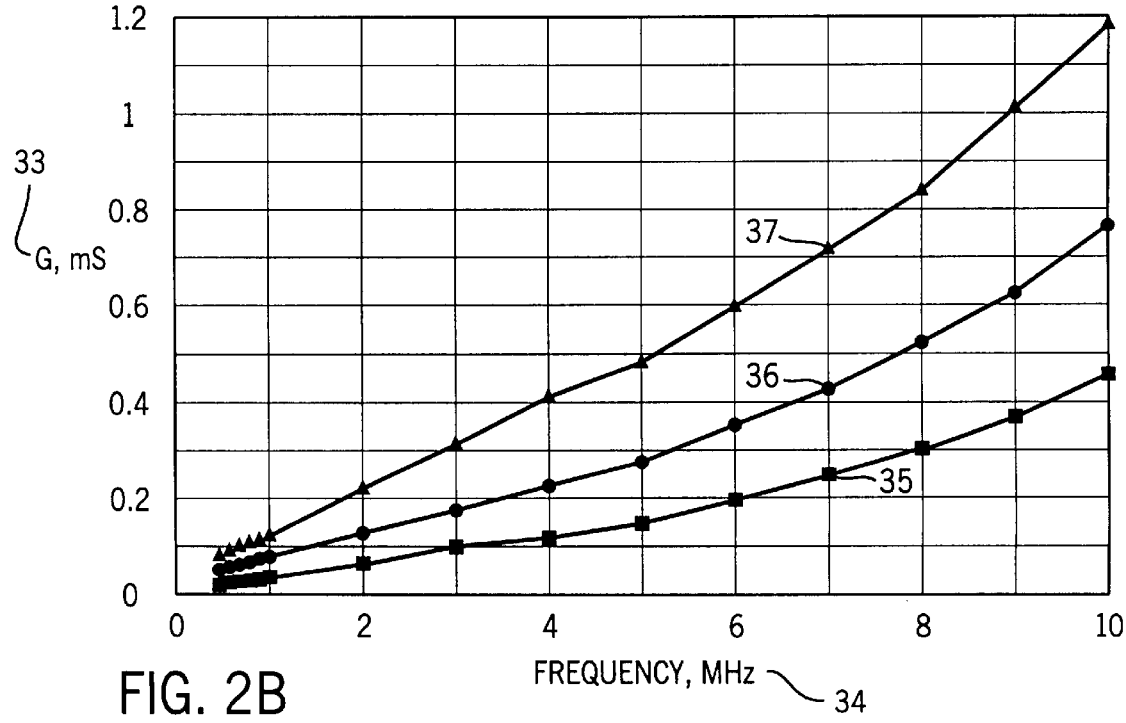
FIG. 2B is a graph similar to the graph of FIG. 2A which plots conductance as a function of frequency for three different thicknesses of sludge deposited on the sidewall of the centrifuge.

FIG. 2B shows a graph similar to FIG. 2A with plots of the conductance 33 as a function of frequency 34 for three different thicknesses of sludge. The first set of points 35 indicates no sludge deposited on the sidewall 20 of the turbine can 5. The second set of points 36 indicates a sludge thickness of approximately 0.3 inches. The third set of points 37 indicates a sludge thickness of approximately 0.4 inches. It can be seen from FIG. 2B that at a given frequency, the conductance of the turbine can 5 in the centrifuge 13 also varies as a function of sludge thickness. Thus, a measurement of capacitance and/or conductance can be used to determine the thickness of a sludge layer being deposited on the sidewall of a rotating turbine can in a centrifuge. This measurement can be performed continuously while the centrifuge is operating.

Figure 3:
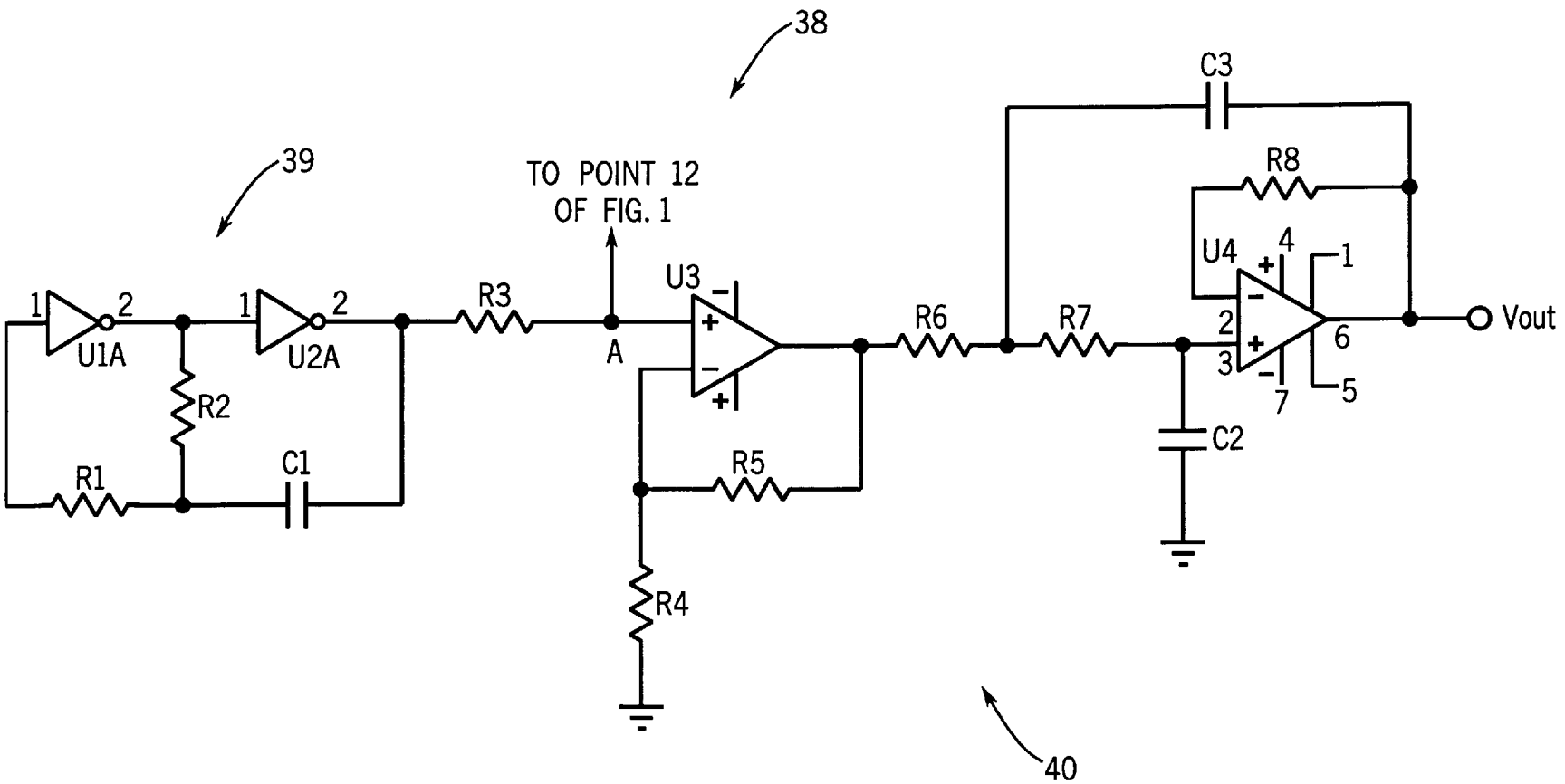
FIG. 3 is a schematic diagram of an electrical circuit which is used to measure the electrical admittance in the centrifuge.
Figure 4:
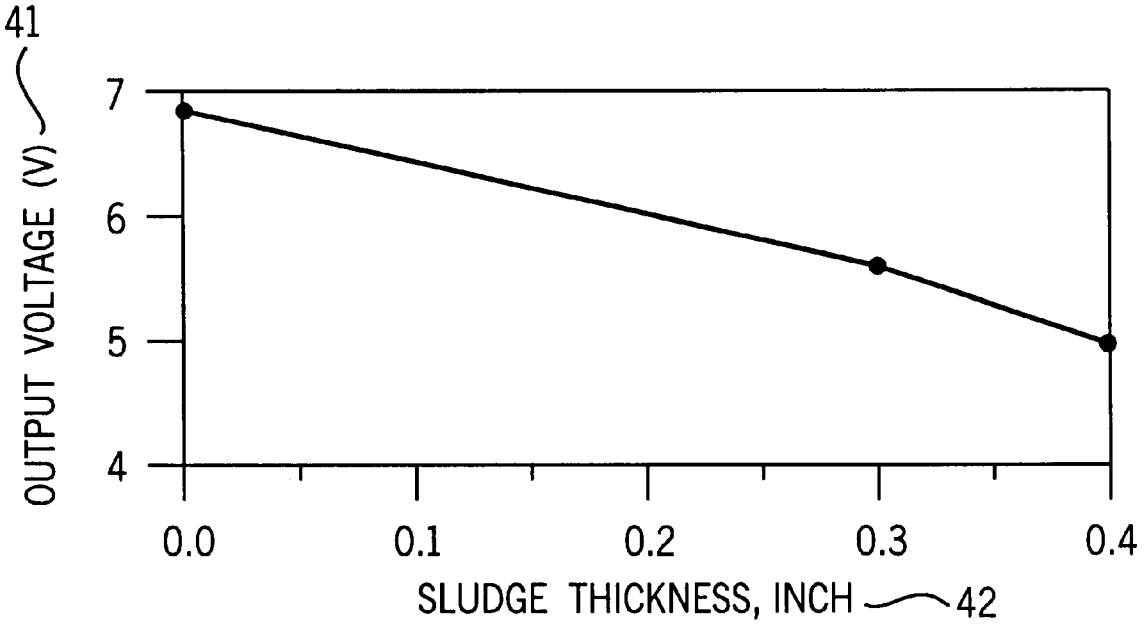
FIG. 4 is a graph which plots the output voltage of the electrical circuit in FIG. 3 as a function of sludge thickness.

FIG. 3 illustrates an electrical circuit 38 which is coupled to the centrifuge 13 for measuring the admittance (capacitance or conductance) between point 12 on the sidewall 20 of the turbine can 5 and the base 16, shaft 1, or body 7 of the centrifuge 13 which are all at ground potential as shown in FIG. 1. As mentioned previously, the sludge thickness can be determined by measuring the admittance (capacitance or conductance) between point 12 on the centrifuge 13 and ground. The circuit 38 includes a free running oscillator 39 which generates a square wave signal at a frequency of approximately 1 MHz. The free running oscillator 39 is comprised of two inverters UA1 and UA2, resistors R1, R2, R3 and a capacitor C1. Point A of the circuit 38 is electrically coupled to the sidewall 20 of the turbine can 5 at point 12. The circuit 38 measures the admittance (capacitance or conductance) between the sidewall 20 of the rotating turbine can 5 and the base 16, shaft 1, or body 7 of the centrifuge (ground) in the form of a voltage. The voltage varies as a function of sludge thickness as shown in FIG. 4. In addition, as the sludge thickness increases, the admittance between point A (point 12) and ground increases as well. This results in a decrease in the voltage between point A (point 12) and ground. The second part of circuit 38 is an amplifier circuit 40 for amplifying the voltage between point A and ground. The amplifier circuit 40 includes operational amplifiers U3 and U4, resistors R4, R5, R6, R7, R8 and capacitors C2 and C3.

A graph of the output voltage 41 as a function of sludge thickness 42 for a typical centrifuge is shown in FIG. 4. Note that the output voltage 41 decreases as the sludge thickness 42 increases. Thus, a very small change in sludge thickness can be accurately measured by measuring the output voltage of the circuit 38 coupled to a centrifuge 13.

It is recognized that other equivalents, alternatives, and modifications aside from those expressly stated, are possible and within the scope of the appended claims.

We claim:

1. A method of continuously measuring the average thickness of sludge being formed against the entire sidewall of a rotating turbine can in a centrifuge from a flow of material into the rotating turbine can, the centrifuge having an inner structure and an outer structure, the method comprising the steps of:

(a) providing the turbine can free of internal structure;

(b) electrically isolating the turbine can from the inner and outer structures of the centrifuge; and (c) coupling an electrical circuit between the rotating turbine can and the isolated inner or outer structure of the centrifuge to continuously measure a temperature-independent parameter indicative of the average thickness of sludge formed along the entire sidewall in said can.

2. A method of continuously measuring the thickness of sludge being formed against the sidewall of a rotating turbine can in a centrifuge from a flow of material into the rotating turbine can, the centrifuge having an inner structure and an outer structure, the method comprising the steps of:

(a) electrically isolating the turbine can from the inner and outer structures of the centrifuge; and (b) coupling an electrical circuit between the rotating turbine can and the isolated inner or outer structure of the centrifuge to continuously measure a parameter indicative of the thickness of sludge in said can, wherein the step of electrically isolating the turbine can from the inner and outer structure of the centrifuge comprises providing a first insulating member between the sidewall of the rotating turbine can and the inner structure of the centrifuge and providing a second insulating member between the turbine can and the outer structure of the centrifuge.

3. The method of claim 2 wherein the inner and outer structure of the centrifuge are electrically shorted together at ground potential.

4. The method of claim 2 further comprising the step of positioning said first insulating member and said second insulating member at locations that maintain the centrifuge in a balanced condition so that the sludge is deposited in a substantially uniform manner on the sidewall of the rotating turbine can.

5. The method of claim 2 wherein said parameter is admittance.

6. The method of claim 2 wherein said parameter is capacitance.

7. The method of claim 2 wherein said parameter is conductance.

8. The method of claim 2 where said parameter is voltage.

9. The method of claim 2 wherein the electrical circuit includes a free running oscillator for generating a signal at a given frequency for input to the sidewall of the rotating turbine can, and an amplifier circuit for measuring and amplifying a voltage established between the sidewall of the rotating turbine can and the inner or outer structure of the centrifuge.

10. In a centrifugal apparatus including a rod-free rotary turbine can, a base, a central shaft and a body, and means for delivering a flow of material into the can while the can is rotating to form sludge against the sidewall of the can, the improvement including means for electrically isolating the rotary turbine can from the combined base, shaft and body and means for measuring the average thickness of sludge being deposited on the entire sidewall of the turbine can independent of measuring temperature in the can.

11. The apparatus of claim 10 wherein the means for electrically isolating the rotary turbine can from the combined base, shaft and body includes inserting at least one insulating member between the rotary turbine can and the combined base, shaft and body.

12. The apparatus of claim 10 wherein the means for measuring the thickness of sludge being deposited on the sidewall of the rotary turbine can includes an electrical circuit coupled to the apparatus between the rotary turbine can and the combined base, shaft and body,the electrical circuit generating a signal at a given frequency for input to the turbine can and measuring a signal between the rotary turbine can and the combined base, shaft and body.

13. The apparatus of claim 12 wherein the measured signal varies as a function of sludge thickness deposited on the sidewall of the rotary turbine can.

14. An apparatus for measuring the thickness of sludge being deposited on the sidewall of a rotating turbine can in a centrifuge from a flow of material into the rotating turbine can, the centrifuge having an inner structure and an outer structure, the apparatus comprising:

a first insulating member disposed between the sidewall of the rotating turbine can and the inner structure of the centrifuge;

a second insulating member disposed between the turbine can and the outer structure of the centrifuge; and an electrical circuit coupled between the sidewall of the rotating turbine can and the isolated inner or outer structure of the centrifuge to continuously measure a parameter indicative of the thickness of sludge on the sidewall of the centrifuge.

15. The apparatus of claim 14 wherein said parameter is selected from the group consisting of admittance, capacitance, conductance and voltage.

16. The apparatus of claim 14 wherein the electrical circuit continuously measures the voltage between the sidewall of the rotating turbine can and the inner or outer structure of the centrifuge for determining the thickness of sludge being deposited on the sidewall of the rotating turbine can during operation of the centrifuge.

* * * * *